United States Patent [19]

Pazzini

[11] Patent Number: 4,557,471

[45] Date of Patent: Dec. 10, 1985

[54] MEDICAL BED

[75] Inventor: Norbert Pazzini, Villemur sur Tarn, France

[73] Assignee: Societe Medi 2000 S.A.R.L., Langon, France

[21] Appl. No.: 534,626

[22] Filed: Sep. 16, 1983

[51] Int. Cl.[4] ..... A61G 13/00

[52] U.S. Cl. ..... 269/325

[58] Field of Search ..... 269/323, 324, 325; 378/208, 209

[56] References Cited

U.S. PATENT DOCUMENTS

| | | | |
|---|---|---|---|
| 2,217,783 | 10/1940 | Bell | 269/325 |
| 3,206,188 | 9/1965 | Douglass | 269/325 |
| 4,195,829 | 4/1980 | Reser | 269/325 |

FOREIGN PATENT DOCUMENTS

| | | |
|---|---|---|
| 0672192 | 2/1939 | Fed. Rep. of Germany . |
| 1306095 | 9/1962 | France . |
| 1564040 | 3/1969 | France . |
| 1347920 | 2/1974 | United Kingdom . |

*Primary Examiner*—James G. Smith
*Assistant Examiner*—Judy J. Hartman
*Attorney, Agent, or Firm*—Sandler & Greenblum

[57] ABSTRACT

A medical bed including a base, a platform comprising several sections, and adjustment apparatus for adjusting the height, the longitudinal and lateral slope of the platform and the position of the platform sections with respect to each other. Also provided is a base having a main beam transverse to the platform which is mounted on the height position adjustment apparatus. The longitudinal slope adjustment apparatus is also mounted on this beam. The lateral slope adjustment apparatus of the platform is mounted on the longitudinal slope adjustment apparatus and the median section of the platform is mounted on the lateral slope adjustment apparatus.

17 Claims, 29 Drawing Figures

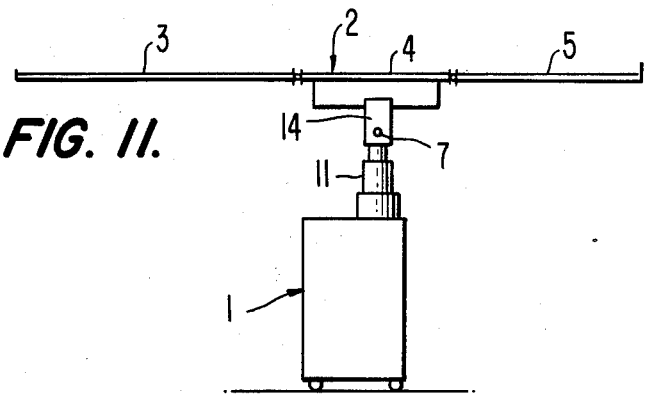
FIG. 11.
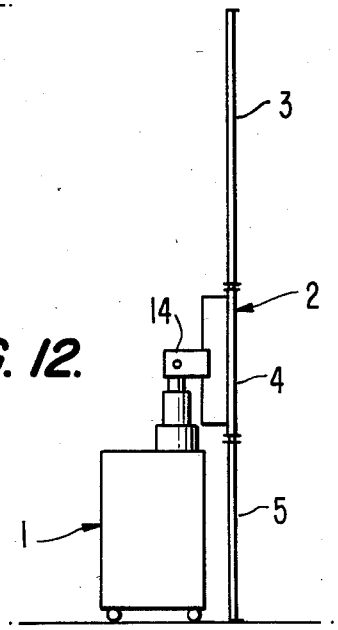
FIG. 12.
FIG. 13.
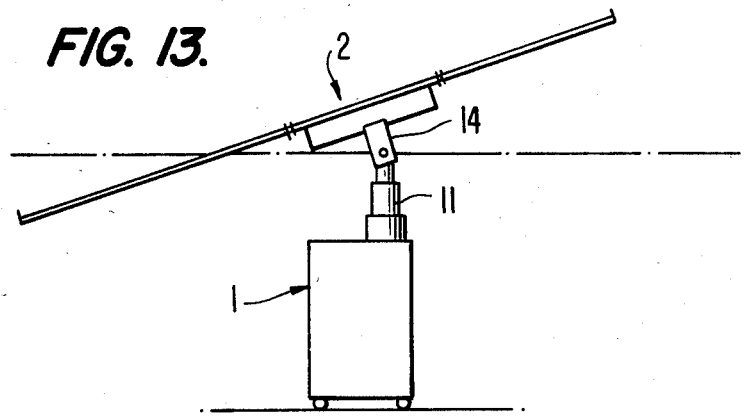

MEDICAL BED

BACKGROUND OF THE INVENTION

1. Field of the Invention

The present invention relates to a medical bed.

2. Description of the Prior Art

Medical beds or tables comprise a base and a platform supporting the patient. Also included are means for adjusting the height, and the longitudinal and lateral slope of the platform. The platforms of such beds or tables comprise several sections which are adapted to be displaced with respect to one another. Such a surgical table is described in French patent application 1.306 095 filed Aug. 30, 1961 by RITER COMPANY INC.

According to this patent, the height and slope adjustment means of the platform are located in the base. These adjustment means comprise a vertical central jack adapted to adjust the height of the platform, two lateral jacks for adjusting the slope of the platform by rotating the platform around a longitudinal axis, and a jack for rotating the platform around a transverse axis. This embodiment also provides the base of the table with one or several platforms which receive one of the ends of the lateral jacks. These platforms are adapted to be raised and lowered conjointly with the movement of the central jack rod so as to permit the adjustment of the slope of the platform when it is in its highest position. This embodiment also provides the base of the table with vertical guiding slides for the platforms and with an apparatus to transmit the movement of the central jack rod to the platform.

This invention requires the use of numerous mechanical elements, which increases the weight of the table and increases the cost of manufacture of such a table.

In addition, to these features described in this French patent, medical beds or tables are generally furnished with a platform having several sections corresponding respectively, to the dorsal zone, to the femoral zone and to the zone of the lower extremities of the patient.

These different sections are journalled on each other and are adapted to be displaced with respect to each other. Generally the means employed for displacing a section with respect to another section comprises a hydraulic jack fixed at one end to two tabs, respectively, integral with two sections. The main disadvantage of this embodiment is that in order to have a sufficient displacement of one section with respect to another section, the stroke length of the jack rod must be relatively large. In addition, when the rod is completely opened out from the body of the jack, the forces exerted thereon tend to prematurely wear out the guiding bore of this rod. As a result, the jack will lose its waterproof quality. Also, the beds or tables of the prior art are not furnished with means sufficient to permit a lateral tilting of the platform in the two directions and to arrange the platform in a vertical position and along a rearward slope position.

SUMMARY OF THE INVENTION

The present invention has as its object to obviate the above-mentioned inconveniences, by providing a medical bed or medical table having a simple design which, as a result, is inexpensive to manufacture.

Another object of the present invention is to provide a medical bed or table furnished with a new means for the displacement of one section with respect to another section.

To this end, the medical bed according to the present invention comprises a base, a platform in one or several sections, and a means to adjust the height and the longitudinal slope of the platform. In addition, a base is provided with a main beam which is horizontal and transverse to the platform and connected to the means for adjusting the height of the base of the platform. In addition, the longitudinal slope adjustment means of said platform is mounted on this main beam and the transverse or lateral slope adjustment means of the platform is mounted on this longitudinal slope adjustment means.

BRIEF DESCRIPTION OF THE DRAWINGS

Other advantages and characteristics of the invention will appear upon reading the description of a preferred embodiment given by way of non-limiting example by referring to the attached drawings in which:

FIGS. 11 through 13 are schematic views showing various longitudinal slope positions of the platform;

DETAILED DESCRIPTION OF PREFERRED EMBODIMENTS

Figure 1:
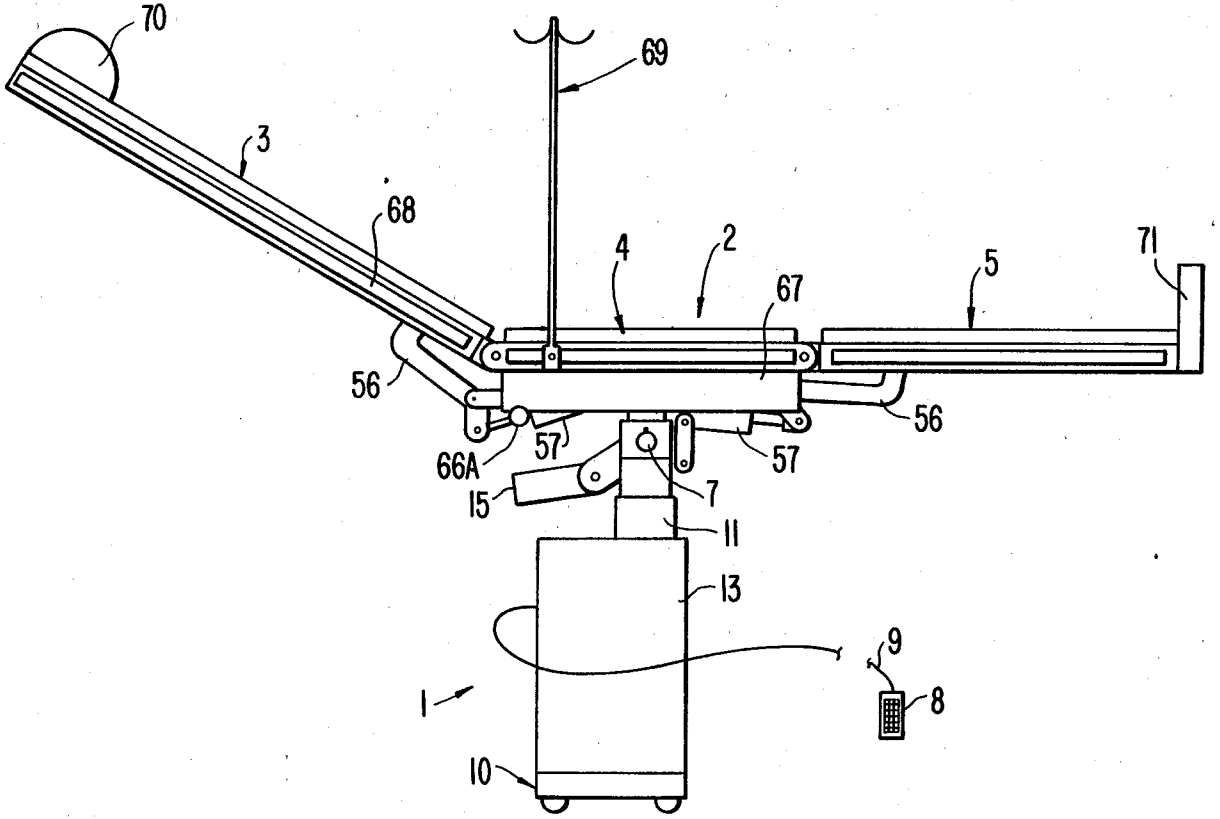
FIG. 1 is a front view of a bed according to the present invention.
Figure 2:
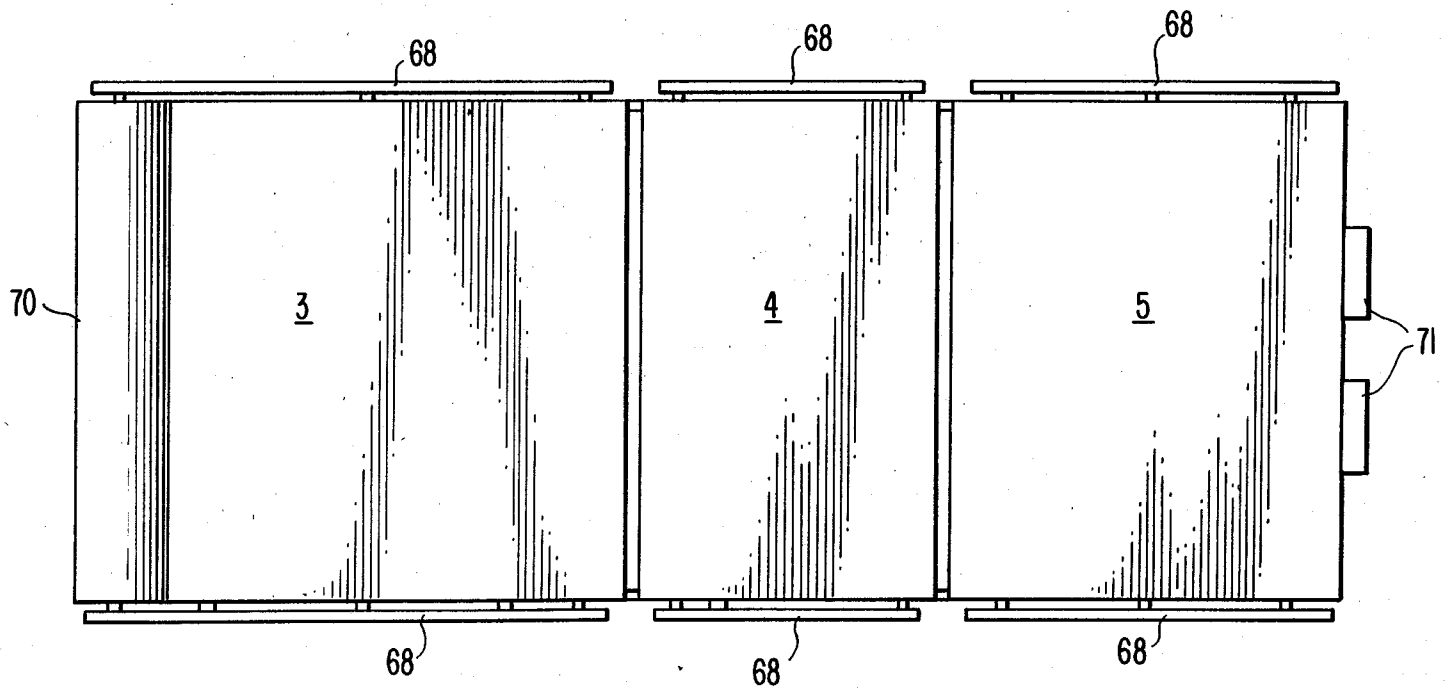
FIG. 2 is a top view of the bed according to the present invention.
Figure 3:
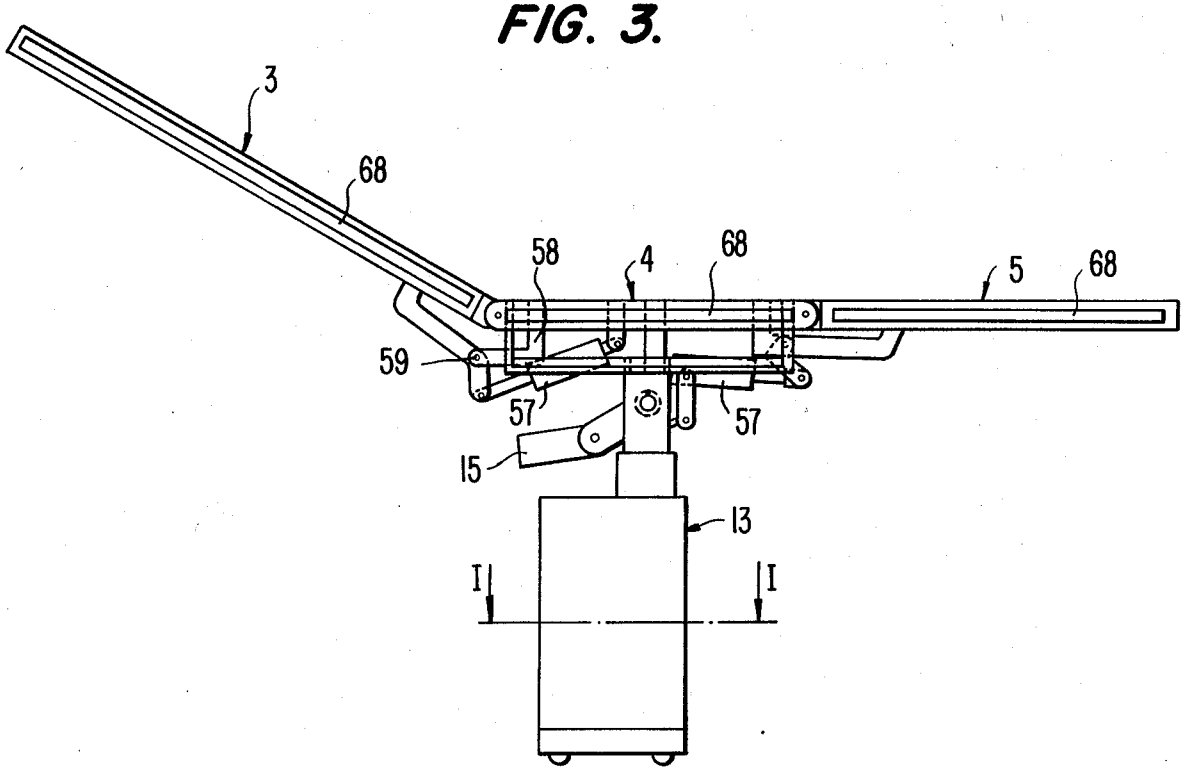
FIG. 3 is a front view of the bed without its coverings.

As illustrated in FIG. 1, the medical bed according to the present invention comprises a base 1 and a platform 2 composed of several sections 3, 4, and 5, which respectively support the dorsal zone, the femoral zone and the zone of the lower extremities of the patient. Also provided are means for adjusting the height and the lateral and longitudinal slope of the platform. In addition, the bed also comprises adjustment means for adjusting the position of the platform sections with respect to each other.

According to a preferred embodiment, base 1 is provided with a main beam 7 on which the longitudinal slope adjustment means of the platform is mounted. Different longitudinal slopes of the platform are obtained by rotating the longitudnal axis of the platform around a transverse axis in one direction or in another. The lateral slope adjustment means of the platform is mounted on the longitudinal slope adjustment means. Adjustment of the lateral slope of the platform is accomplished by rotation of the lateral axis of the platform around at least one axis longitudinal to said platform in one direction or in the other direction. Median section 4 is mounted on the lateral slope adjustment means of the platform. These various means are located so as to form a so-called open chain formation which simplifies the formation of such a bed and permits simultaneous control of the various movements of the bed.

The means for adjusting the height and the slope of the bed and for adjusting the position of sections 3, 4 and 5 of platform 2 with respect to each other are controlled by pushbuttons located in a housing 8 connected by a flexible electric cable 9 to the controls of the various means, as seen in FIG. 1.

Figure 5:
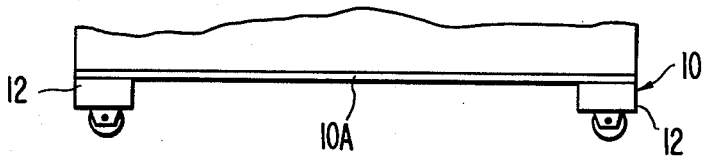
FIG. 5 is an enlarged view of the base of the bed.

Base 1 comprises a horizontal bedplate 10 including a wheel apparatus, and a vertical column 11 supporting main beam 7 at one of its end. As seen in FIGS. 5 an 6 bedplate 10 comprises two spaced apart parallel frames 12, including wheels and a metal horizontal wall 10A, of a rectangular form, fixed on frames 12. Column 11 is fixed near one of the edges of wall 10A in any known manner. Column 11 is preferably telescopic so as to adjust the height of the platform. Preferably, column 11 comprises a telescopic, hydraulic jack of any known type. This jack is also preferably provided with a telescopic, hydraulic protection housing 11B of any known type. Between this housing and the jack the conduits of the hydraulic circuit are spirally arranged. These conduits are fixed to the protection housing by any known means.

Figure 6:
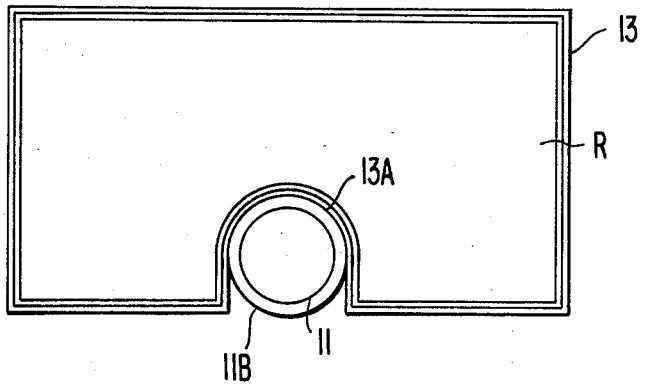
FIG. 6 is a cross-sectional view along line I/I in FIG. 3.
Figure 7:
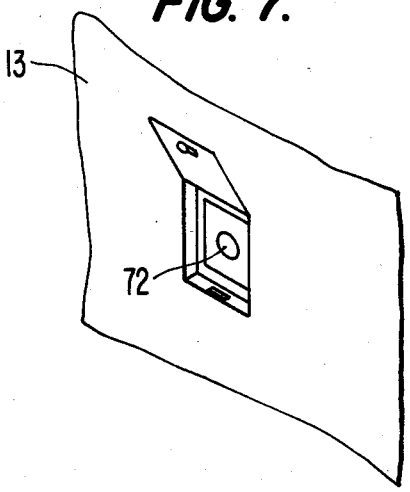
FIG. 7 is an enlarged view of the caisson of the bed.
Figure 8:
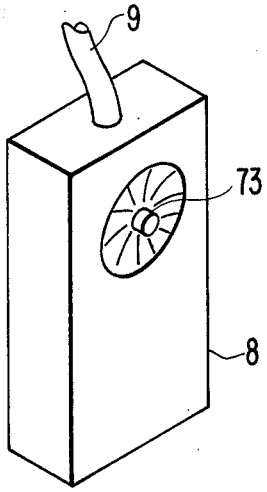
FIG. 8 is a rear view of the control box of the present invention.

As seen in FIG. 6, this jack is connected to a hydraulic circuit comprising a liquid reservoir R, a pump for injecting the liquid into one of the chambers of jack 11, and a distributor having three positions, wherein in two of these positions the distributor is designed to control the direction of hydraulic fluid circulation in the jack, and as a result, control the in and out or reciprocating movement of the rod. When the distributor is in its third position, it is designed to stop circulation of the fluid and thus stop these two movements.

Preferably, the distributor of jack 11 is of the type that is driven by electromagnets. The electromagnets of this distributor are controlled from several pushbuttons on housing 8. The various elements of the hydraulic circuit of jack 11 are located in a caisson 13 mounted on bedplate 10 of the base. As can be seen in FIG. 1, the caisson is in a substantially parallelepiped shape and covers the entire surface of the horizontal wall 10A and extends transversely to the platform of the bed. One of the vertical walls of caisson 13 is provided with a hollow form 13A extending vertically to support column 11. This hollow form is obtained by cambering or by any other known process.

Reservoir R is also preferably provided with a hollow form to receive the cambered zone of the caisson wall. The pump and the electric motor of the pump are mounted on this reservoir. For safety reasons, reservoir R is made of an electrically non-conductive material.

Reservoir R is preferably mounted on an elastic element to prevent the transmission of vibrations to column 11 and thus to platform 2.

According to a preferred embodiment, the elastic elements each comprise a block of an elastic material, for example, rubber. Horizontal main beam 7 is mounted along the transverse axis of the platform at the end of jack rod 11. Beam 7 is preferably composed of metal and is in the form of a full cylinder. The beam is engaged and locked against translation and rotation in a cylindrical opening located in the upper part of the piston rod. Beam 7 also extends transversely with respect to platform 2 of the bed. The longitudinal slope adjustment means of platform 2 are mounted on main beam 7.

Figure 9:
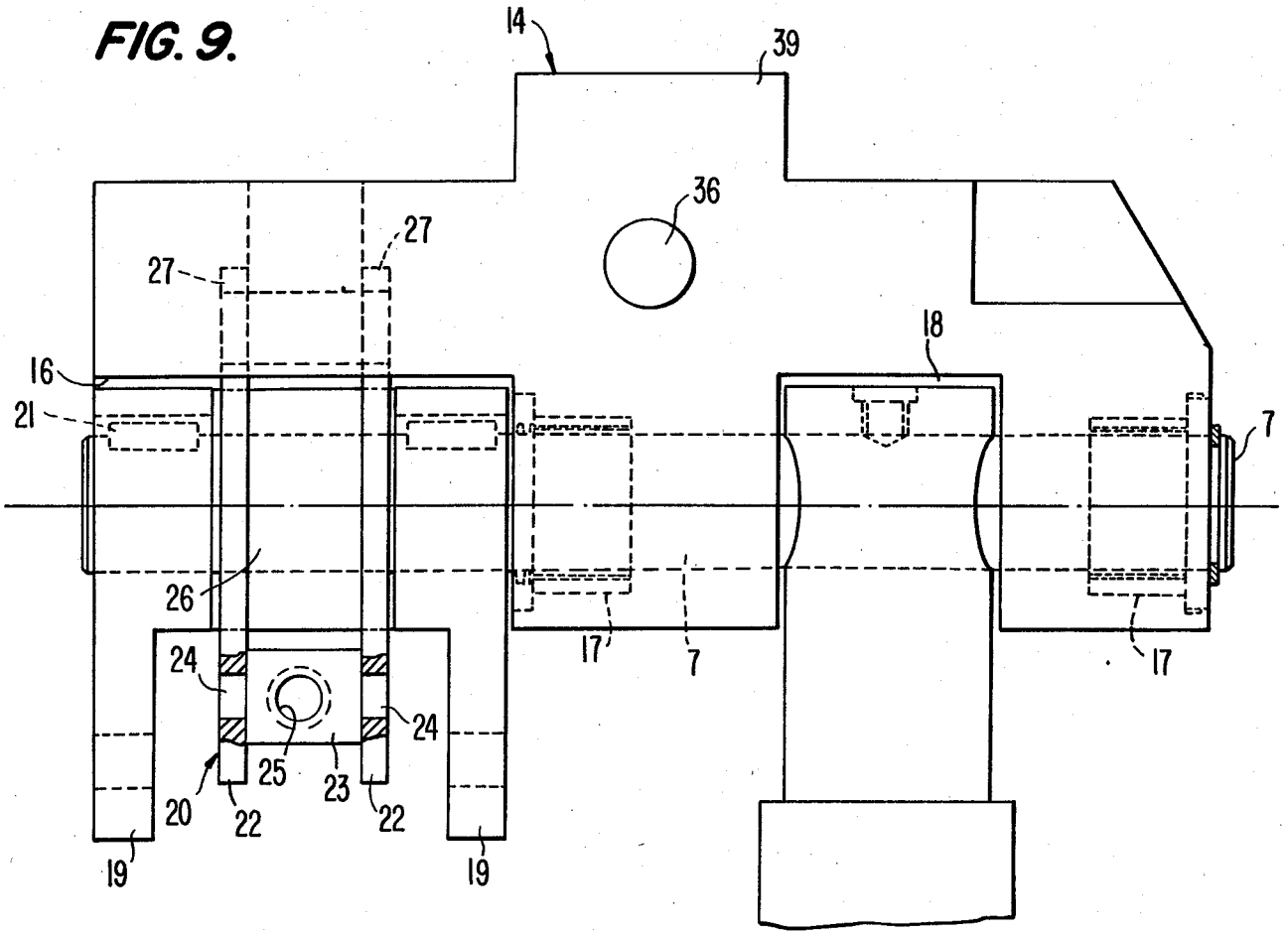
FIGS. 9 and 10 are views of the longitudinal slope adjustment means of the platform of the bed.
Figure 10:
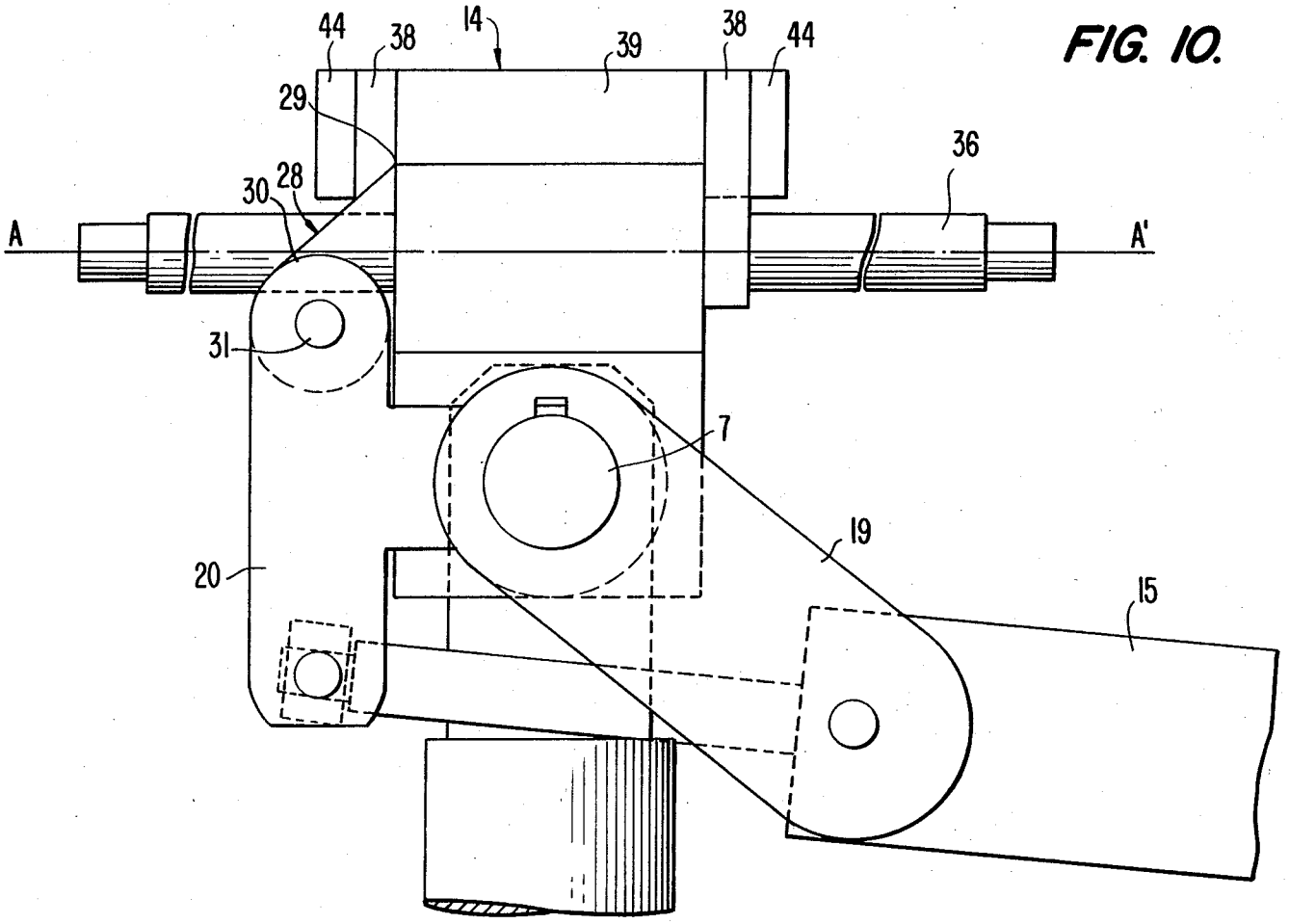

According to a preferred embodiment, as seen in FIGS. 9 and 10 this means for adjusting the longitudinal slope of platform 2 comprises a shoe 14 journalled on main beam 7 and supports the lateral slope adjustment means of the platform. In addition, a motor element 15 for rotating shoe 14 around beam 7 clockwise or counterclockwise is provided. As can be seen more particularly in FIGS. 4A, 4B and 9, the preferably metal shoe is substantially in the shape of a parallelepiped and provided with a rectangular-shaped groove 16. Shoe 14 is also provided with two bearings 17 in which main beam 7 is engaged. Between these two bearings the shoe has a transverse slot 18 in which the upper end of the height adjustment means of the platform is engaged.

Motor element 15, which rotates shoe 14 around beam 7, is mounted laterally with respect to jack 11 and under groove 16. Motor element 15 preferably comprises a hydraulic jack, the body of which is journalled on two tabs 19 integral with main beam 7 and inclined with respect to the axis pin of jack 11. In addition, the hydraulic jack also comprises a rod, the end of which is journalled on a tab 20 fixed to shoe 14. The reciprocating, (or the in and out movement of the jack rod causes shoe 14 to rotate around main beam 7.

The position of shoe 14 in FIG. 10 is that corresponding to the horizontal position of the median section of the platform or of its longitudinal axis. In this figure it can be seen that jack rod is at its halfway point, in which it extends halfway out of the body of the jack. As a result, from the position shown in FIG. 10, shoe 14 can be rotated around beam 7 clockwise or counterclockwise by the reciprocating movement of the jack rod, and consequently, platform 2 can tilt downwardly or upwardly. The present invention can also position platform 2 so that it is spaced apart from main beam 7, as seen in FIG. 11. When this occurs, platform 2 can be moved from its horizontal position seen in FIG. 11 to a vertical position seen in FIG. 12, by rotation around main beam 7. In this position, section 3 is disposed in its highest vertical position and section 5 is disposed in its lowest vertical position. In addition, in this vertical position, jack rod 15 is recessed in the body of the jack. As a result of this recessing of jack rod 15, the platform of the bed can be rotated around main beam 7 in a continuous movement from its vertical position to a downward position seen in FIG. 13. This movement is controlled by an opening movement of jack rod 15. In this position, section 5 is raised with respect to section 3. By way of example, the platform of the bed may be tilted rearwardly 20° with respect to a horizontal axis.

The hydraulic circuit of jack 15 is connected to the pump and to reservoir R and comprises a distributor driven by an electromagnet having three distinct positions. A first position of the distributor corresponds to the outward movement of the rod of the jack. A second position of the distributor corresponds to the inward movement of the rod. A third position of the distributor causes a stopping of these movements of the rod. This distributor is mounted in caisson 13 and its electromagnets are controlled from several pushbuttons on housing 8.

As can be seen in FIGS. 9 and 10, two tabs 19 are each furnished with a cylindrical opening at one end thereof to engage beam 7. Tabs 19 are locked against rotation with respect to beam 7 preferably by pins 21. The other or free ends of tabs 19 are each furnished with a cylindrical opening in which the journal pin of jack 15 is engaged. Tab 20 is mounted on shoe 14 along the plane median with respect to two tabs 19 and transverse to beam 7.

Tab 20 has two lower wings 22, parallel to the above-mentioned median plane and spaced apart from each other. Between these two wings an attachment element 23 of the end of jack rod 15 is rotatably mounted, so that it is journalled on tab 20. As can be seen in FIG. 9, this attachment element has a cylindrical or parallelepiped form and is adapted to receive two lateral journal pins 24 in a cylindrical opening located in each wing 22. Element 23 is also provided with a threaded cylindrical opening 25 located along the plane median with respect to the two tabs 19 and transverse to beam 7. The threaded end of jack rod 15 engages this opening. It is evident that any other type of journal can be employed. Thus, for example, jack rod 15 can be provided with a rod end strap cooperating with an axis pin integral with tab 20.

In order to avoid the torsion forces of shoe 14 with respect to beam 7 during the movement of jack rod 15 on tab 20, shoe 14 is provided with a bearing 26 engaging beam 7 between two tabs 19. As a result, the torsion forces on beam 7 due to shoe 14 are mediated by means of bearing 26.

Preferably, tab 20 is also provided with two upper wings 27 parallel to the above-mentioned median plane and transverse to beam 7 and between which is mounted an attachment element 28 to shoe 14. This attachment element comprises a bedplate 29 fixed by any known means to shoe 14, and a projection 30 on bedplate 29, which is engaged between the two wings 28. This arrangement facilitates the mounting of tab 20 on shoe 14. Wings 27 and the projection are pierced along a same axis with a transverse cylindrical opening in which an integrated pin 31 is engaged which extends from tab 20 to element 21 and thus to shoe 14.

As has been previously stated, the shoe supports the lateral slope adjustment means of the platform. This lateral slope adjustment permits the tilting of platform 2 to one lateral side or the other lateral side of the bed. This means as seen in FIG. 4 and FIGS. 15–19 comprises a lower chassis 32 journalled on shoe 14 along an axis AA' in the direction of the longitudinal axis of the platform, and an upper chassis 33. Upper chassis 33 is journalled on lower chassis 32 along an axis BB' parallel to axis AA'. Upper chassis 33 can be folded on lower chassis 32 and is integral with the frame of median section 4. Also provided is at least one motor element 34 for rotating lower and upper chassis 32 and 33 around axis AA' so as to tilt the platform along one of the sides of the bed. In addition, at least one motor element 35 is also provided for rotating upper chassis 33 around axis BB' by means of a lever 35A of upper chassis 33 so as to tilt platform 2 along the other side of the bed.

Lower chassis 32 comprises a journal axis pin 36 and at least two rods 37 of equal length, perpendicular to axis pin 36 and integral at one of their ends with axis pin 36. The other end of rods 37 are journalled on upper chassis 33. Journal axis pin 36 is rotatably mounted in a cylindrical opening located in support 14 along longitudinal axis AA'. Preferably, this opening is provided with two bearings in which axis pin 36 is rotatably mounted. This axis pin is prevented from undergoing translational movement with respect to shoe 15 by any means known in the art. As can be seen in FIGS. 4B and 14–16, this axis pin is transverse to shoe 14 and is centered laterally with respect thereto. At each end of axis pin 36 the end of one of rods 37 is attached. These rods are of rectangular transverse cross-section and are provided with a transverse cylindrical opening so as to be mounted on axis pin 36 and to be journalled to upper chassis 33. The opening in each rod which engages axis pin 36, and axis pin 36 itself each are pierced with the same sized diametrical opening to receive an integrating pin or any other equivalent known mechanical means.

Figure 4:
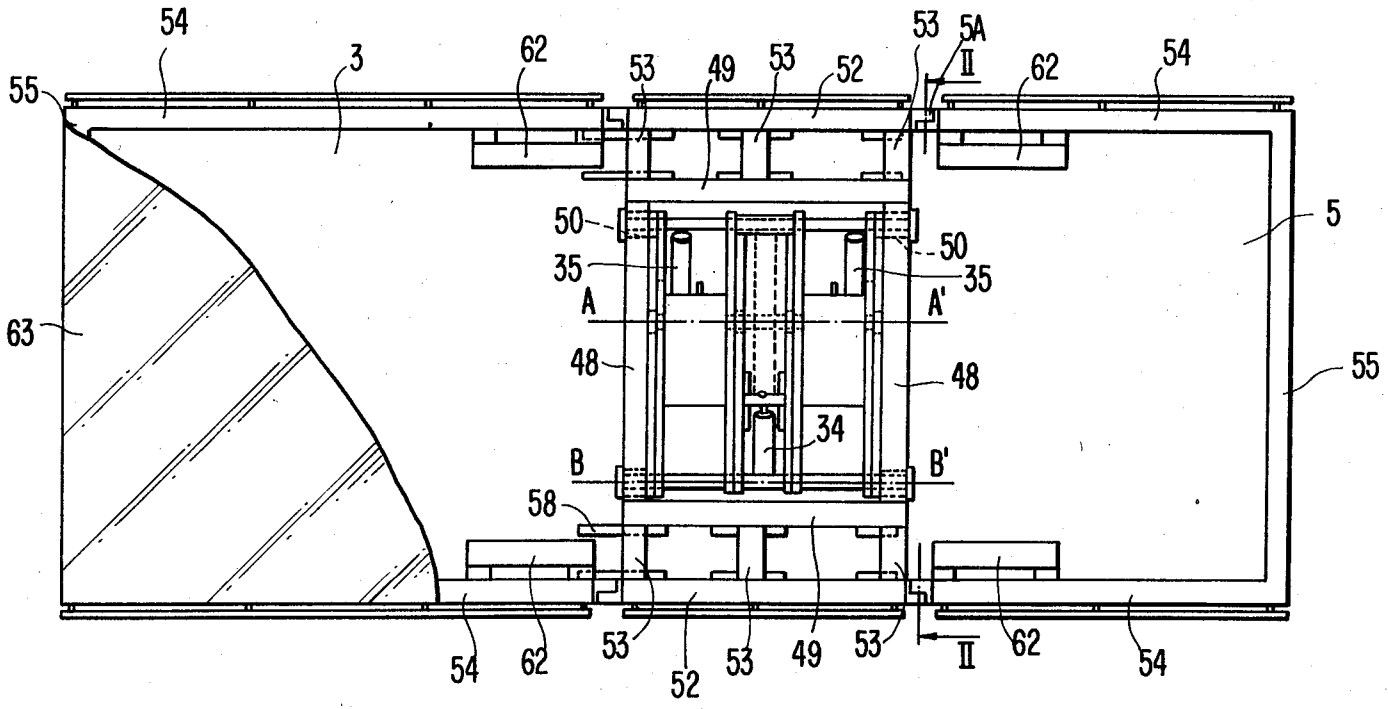
FIG. 4 is a top view of the bed seen in FIG. 3.
Figure 4A:
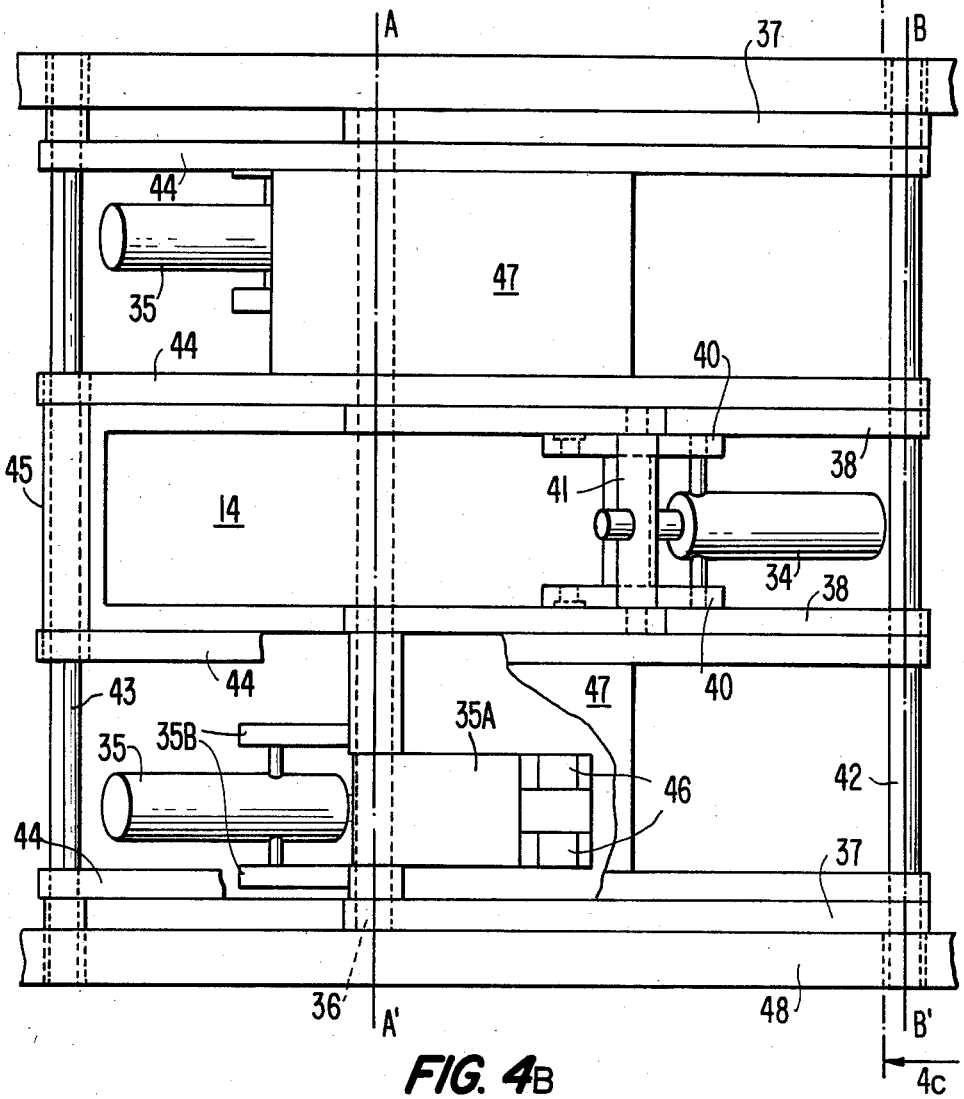
FIG. 4A is an enlarged view of a portion of the bed see in FIG. 4.

Lower chassis 32 also comprises, as seen in FIG. 4A, two rods 38 of rectangular transverse cross-section, which are respectively located at each end of shoe 14. These rods are of the same length as rods 37 and are parallel thereto. Each rod 38 is also furnished at each end with a transverse cylindrical opening, one of which is adapted to be fixed to axis pin 36 and the other of which is adapted to be journalled on upper chassis 33. Rods 38 bear against shoe 14 in order to insure the longitudinal maintenance of the platform in the vertical position. Preferably, rods 38 have a greater width at the points at which they bear against shoe 14. Furthermore, shoe 14 is furnished with a reinforcement 39 at these points of contact. This arrangement increases the surface area of the shoe and the rods that contact each other.

Figure 4B:
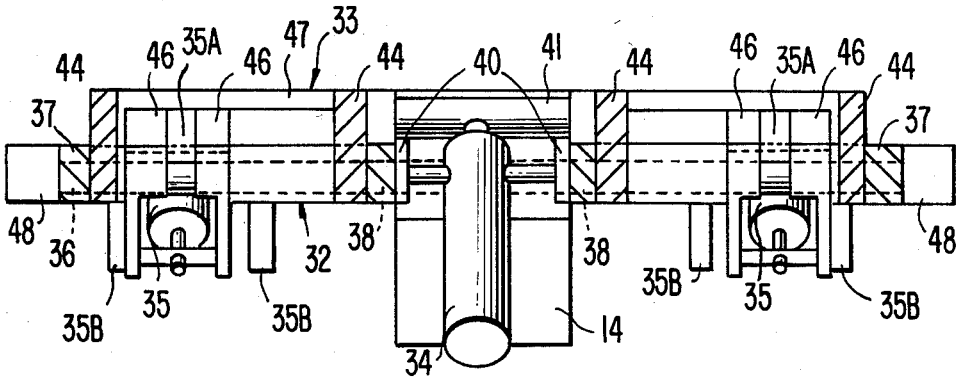
FIG. 4B is a cross-sectional view along line III—III in FIG. 4A.
Figure 16:
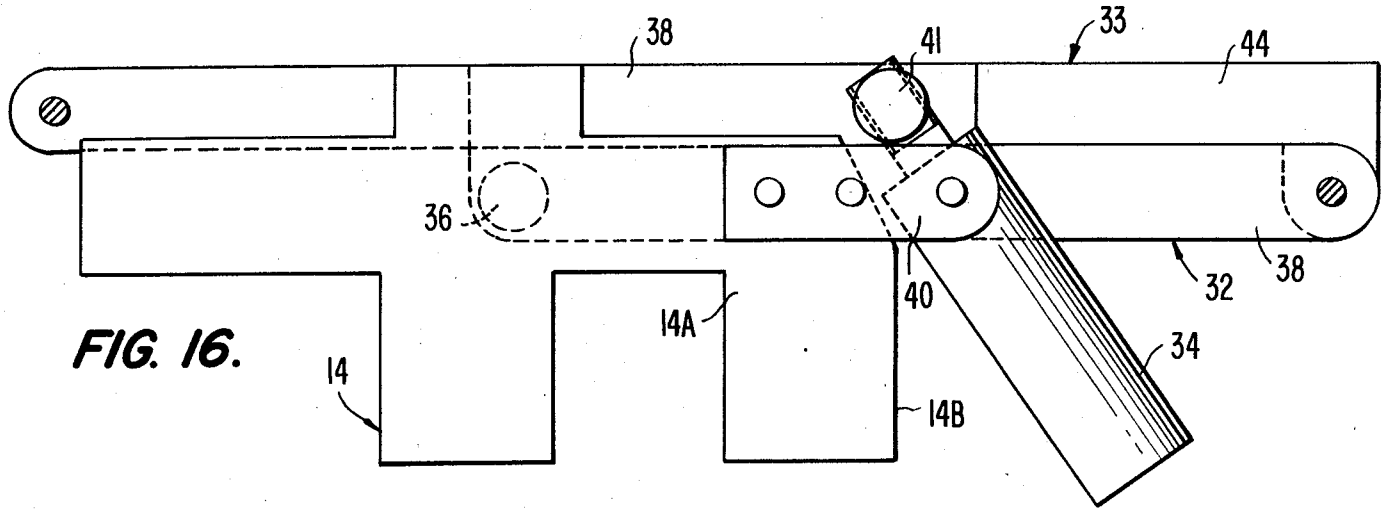

As has been previously stated, chassis 32 and chassis 33 jointly rotate around axis AA' due to motor element 34. As can be seen in FIGS. 4A, 4B and 16, this motor element is located under the lower chassis between rods 38 and between shoe 14 and journal axis BB'. This motor element preferably comprises a hydraulic jack, the body of which is journalled on two tabs 40 integral with shoe 14, and the rod of which is journalled on lower chassis 32.

Figure 17:
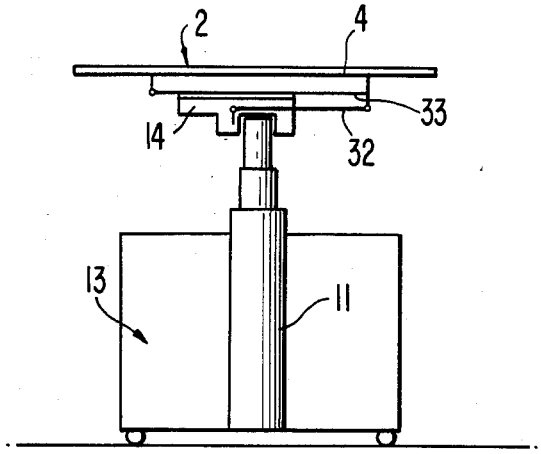
FIGS. 17 through 19 are schematic views showing various lateral slope positions of the platform.
Figure 18:
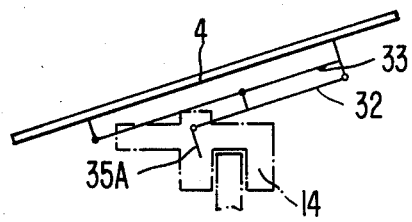

From the horizontal position shown in FIG. 17, motor element 34 controls the rotation of the lower chassis and the upper chassis, and as a consequence, controls the rotation of platform 2 around axis AA', in a counterclockwise direction so as to tilt them along one of the sides of the bed, as seen in FIG. 18. The two tabs 40 are fixed to shoe 14 by any means known in the art. Tabs 40 are each mounted against one of the longitudinal plates 14A of the shoe as seen in FIG. 16, preferably in a hollow form. One of the ends of each tab 40 projects on the rear face 14B of shoe 14 in order to receive jack 34. This jack is mounted so as to journal therebetween. To this end, the free end of each tab is furnished with a transverse cylindrical opening in which a journal pin is engaged integral with the body of the jack. The end of the jack rod is preferably journalled on two rods 38 of the lower chassis.

According to a preferred embodiment, the threaded end of the jack rod is mounted in a threaded cylindrical opening of an axis pin 41 located between rods 38, parallel to axis pin 36, and journalled on each of its ends to each rod 38. Each end this axis pin 41 has a journal pin engaged in a cylindrical opening located in each rod 38. It is within the scope of the invention to use any other type of journal mechanism. The circuit of hydraulic jack 34 connected to the pump and to reservoir R is furnished with a distributor adapted to be placed in three distinct positions. When the distributor is in two of these positions, the distributor controls the movements of the jack rod into and out of the body of the jack. When the distributor is in its third position, the distributor stops these two movements of the jack rod. This distributor is mounted in caisson 13 and driven by electromagnets. The electromagnets are controlled by pushbuttons of housing 8.

Figure 14:
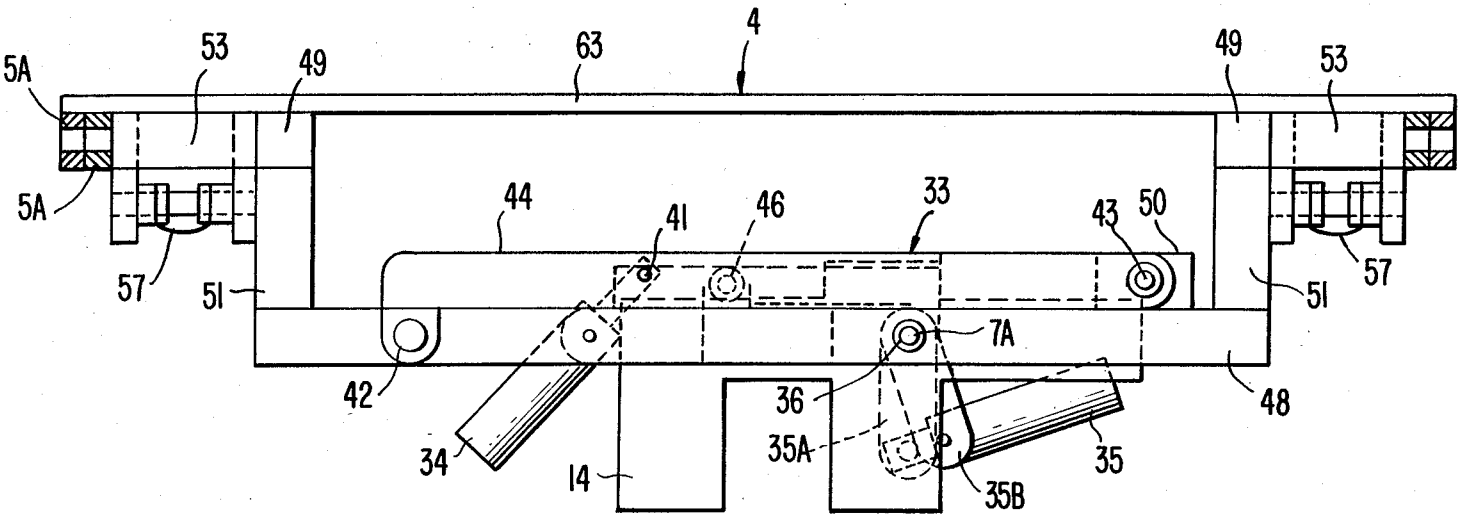
FIG. 14 is a cross-sectional view along line II/II in FIG. 4.

As has been previously stated, upper chassis 33 is journalled on the lower chassis along axis BB'. Upper chassis 33 comprises two axis pins 42 and 43 parallel to axis pin 36 of lower chassis 32. In addition axis pins 42 and 43 are both integral with the frame of median section 4. Axis pin 42 is rotatably mounted at the end of rods 37 and 38 of the lower chassis along axix BB' and on rods 44 parallel to those of the lower chassis. Rods 44 are of equal dimensions and have a length greater than that of the lower chassis. As can be seen in FIG. 14, axis pin 43 is located above the plane defined by axis pins 36 and 42. Rods 44 are of rectangular transverse cross-section, and each have one end bent at a right angle to compensate for the difference in levels between these two axis pins.

Rods 44 have at each end a transverse cylindrical opening adapted to engage axis pins 42 and 43. Preferably, upper chassis 33 is furnished with four rods 44 each adapted to be placed against one of rods 37 and 38 of lower chassis 32 as seen in FIG. 4A. The two median rods are held apart from each other by a crossbar 45 mounted on axis pin 43. Rods 44 bear on axis pin 36, when upper chassis 33 is folded on the lower chassis 32. Due to this arrangement, upper chassis 33 cannot be separated from the lower chassis except along one single rotational direction. As has been previously stated, the upper chassis is adapted to rotate around axis BB' via motor element 35 by means of a lever 35A.

As can be seen in FIG. 4A, the bed according to the invention is equipped with two motor elements 35 located at each end of shoe 14, between two rods 44, and between axis pin 43 and axis pin 36. Each motor element comprises a hydraulic jack, the body of which is journalled on two tabs 35B integral with axis pin 36, and the rod of which is journalled on lever 35A located under lower chassis 32. The two tabs 35B are each provided at one of their ends with a tubular cylindrical element engaged and locked on axis pin 36 by keying or any other process. These tabs 35B are located between two rods 44, these two rods being disposed laterally with respect to the shoe and parallel to its longitudinal face 14A. The two tabs 35B are spaced from each other to rotatably receive jack body 35 therebetween. To this end, the free end of each tab is provided with a transverse cylindrical opening in which a journal pin is engaged, integral with the body of the jack. Lever 35A is rotatably mounted between the two tabs and on axis pin 36. This lever 35A bent at a right angle and is journalled at the lever of its angle to axis pin 36. Lever 35A is also furnished at one of its ends with a roller 46 bearing against the upper chassis. Jack rod 35 is journalled at the other end of the lever.

Figure 15:
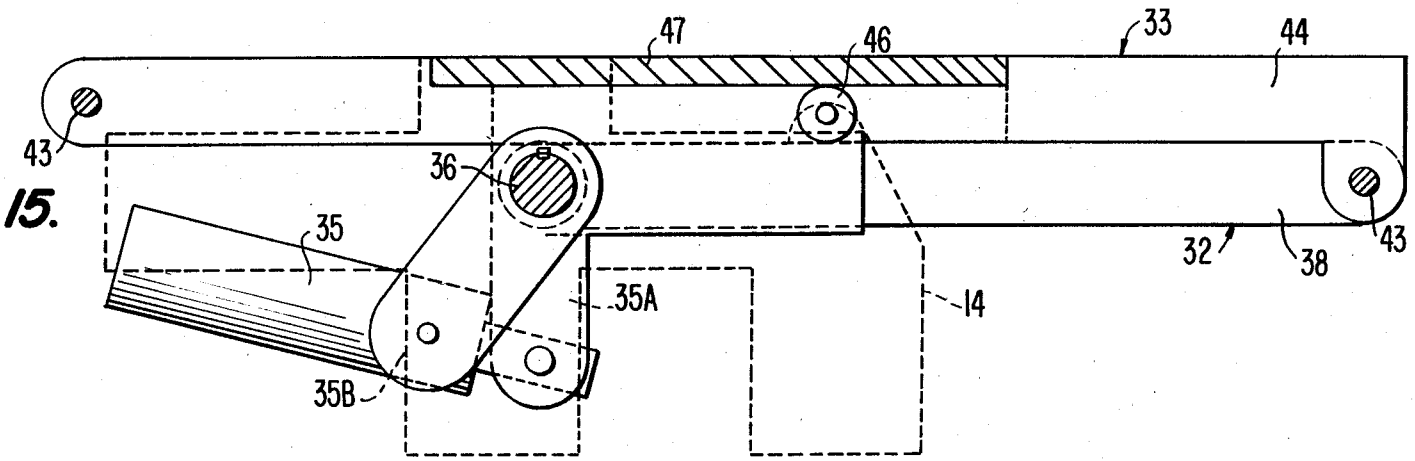
FIGS. 15, 15*a*, 15*b*, 15*c* and 16 are enlarged views of the lateral slope adjustment means of the platform.
Figure 15A:
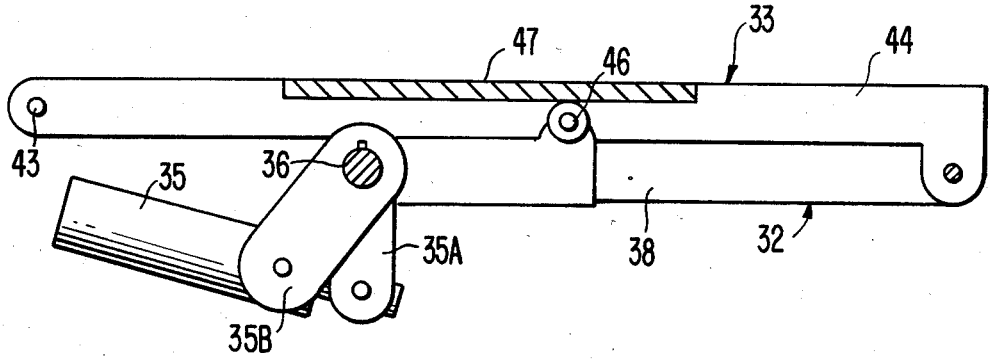
Figure 15B:
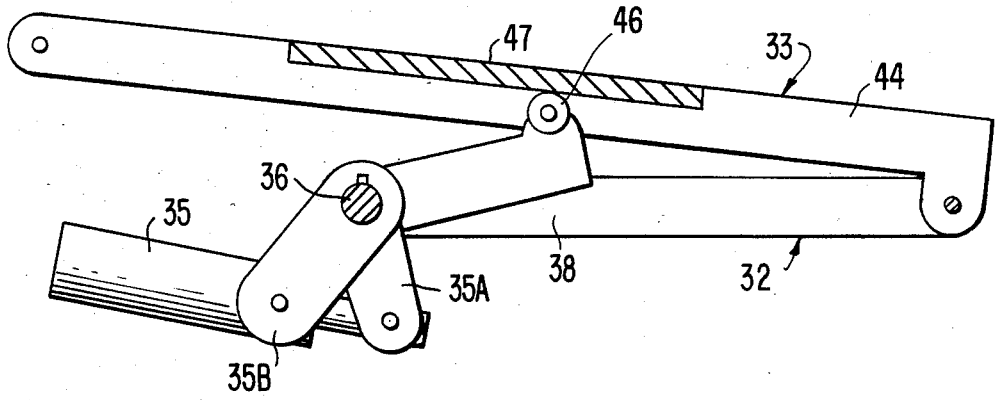
Figure 15C:
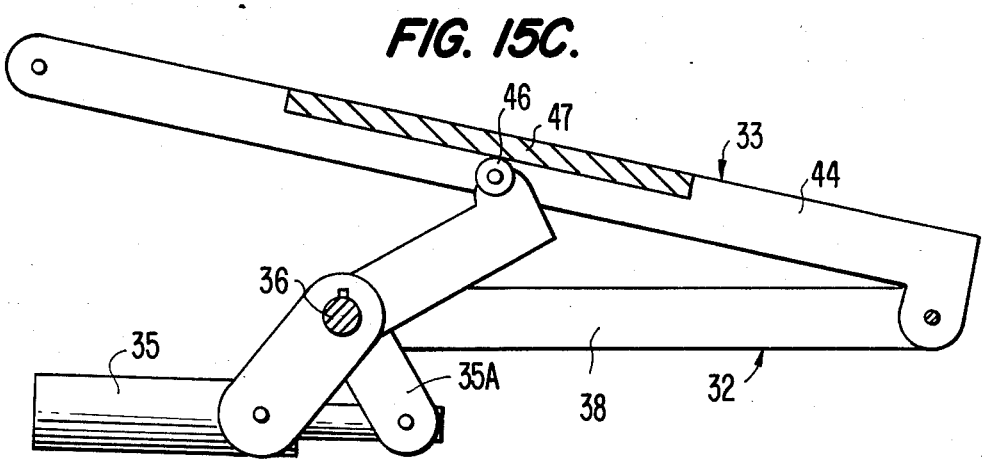
Figure 19:
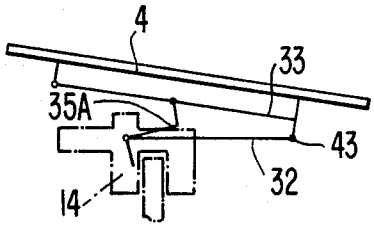

FIG. 15 and FIG. 15*a* show upper chassis 33 folded on lower chassis 32. During the opening of the jack rod, the jack rod acts on lever 35A and causes it to rotate in a counterclockwise direction around axis pin 36. During its rotation, lever 35A separates upper chassis 33 and the frame of section 4 from lower chassis 32 by means of roller 46. This separation occurs by rotation around axis BB' in a clockwise direction to tilt the platform from the other side of the bed, as seen in FIGS. 15*b* and 15*c*. As can be seen in FIG. 19 during the rolling movement of upper chassis 33 around axis BB', the contact point of roller 46 on chassis 33 moves away from axis BB' which increases the stability of the system. Roller 46 is preferably in contact with a metal plate 47 of upper chassis 33, fixed by any known means between two rods 44.

According to another embodiment, roller 46 bears against a roller surface or path located between two rods 44 and integral therewith via any known means. The bed in this embodiment is furnished with two motor elements 35 and with four tabs 46 of two levers 35A, and is provided with two plates 47. The hydraulic circuit of each motor element 35 is connected to the pump and to reservoir R and is furnished with a hydraulic distributor adapted to be displaced into three positions. When the distributor is in two of the positions, the distributor is designed to move the rod into the body or out of the body of the jack. When the distributor is in its third position it is designed to stop these two movements. The electromagnets of each distributor are controlled by pushbuttons on housing 8.

The frame of median section 4 is centered with respect to the height position adjustment means of the platform in order to center the loads on this means. As seen in FIG. 4, the frame of median section 4 is rectangular-shaped and comprises an assembly of two lower crosspieces 48 transverse to the platform of the bed and at least two upper frames 49 parallel to the longitudinal axis of the platform of the bed. Lower metal crosspieces 48 are preferably tubular, have a square transverse cross-section, and are mounted respectively, at each end of upper chassis 33. Each crosspiece 48 is integral with one end of axis pin 42 and with one of the ends of axis pin 43.

These crosspieces 48 are furnished with transverse openings. In each transverse opening a cylindrical tubular element adapted to receive one of the ends of axis pin 42 or 43 is mounted. Preferably, these axis pins have a threading end adapted to receive a nut for locking the crosspiece. After mounting, the nut is judiciously integrated into the bed by rotating the nut by any known means on its axis pin. In order to compensate for the difference in level between axis pins 42 and 43, the crosspieces, at one of their ends, each have an added reinforcement 50 which engages the end of axis pin 43. Tubular upper frames 49 have a square transverse cross-section and are each integral with two tabs 51 which, in turn are integral with the end of one of crosspieces 48. As can be seen in FIG. 14, these tabs 51 are perpendicular to the crosspieces and to the frames. This arrangement separates the frames 49 from the crosspieces 48 and thus from upper chassis 33 for reasons given above.

The frame also comprises two frames 52 located along the longitudinal axis of the platform of the bed and forming two of the sides of median section 4. As can be seen in FIG. 4, each frame 52 is located next to one of frames 49 and is connected therewith by three braces 53 transverse to the platform and respectively located at each of the ends of said frames and along the median zone thereof. Sections 3 and 5 are journalled to the frame of median section 4 previously defined. The frame of these sections 3 and 5 comprises two parallel frames 54 connected by an end crosspiece 55. Each frame 54 is journalled on its free end to one of the ends of one of frames 52. To facilitate this journalling, each frame 52 and each frame 54 has a projection 55A at its end which has a cylindrical opening therein adapted to receive a journal axis pin. At the level of each journal pin, along with any one of sections 3 or 5, median section 4 is equipped with slope adjustment means for adjusting the slope of one of the platform sections with respect to said median section 4. These adjustment means comprise a lever 56 journalled on median section 4 under one of sections 3 or 5, and a motor element 57 such as a hydraulic jack, the body of which is journalled to median section 4, and the rod of which is journalled to lever 56. Lever 56 is journalled on two tabs 58 integral, respectively, with frames 49 and 52 of median section 4. This lever 56 is journalled on an axis parallel to the journal axis around which one of the sections rotates with respect to the other. Lever 56 has a rectangular transverse cross-section, is bent, and is mounted between tabs 58. A transverse cylindrical opening is provided in the bent portion of lever 56, in which a journal axis pin 59 is engaged to connect lever 56 to tabs 58. Jack rod 57 is journalled to one of the ends of the lever by any known means.

Figure 21:
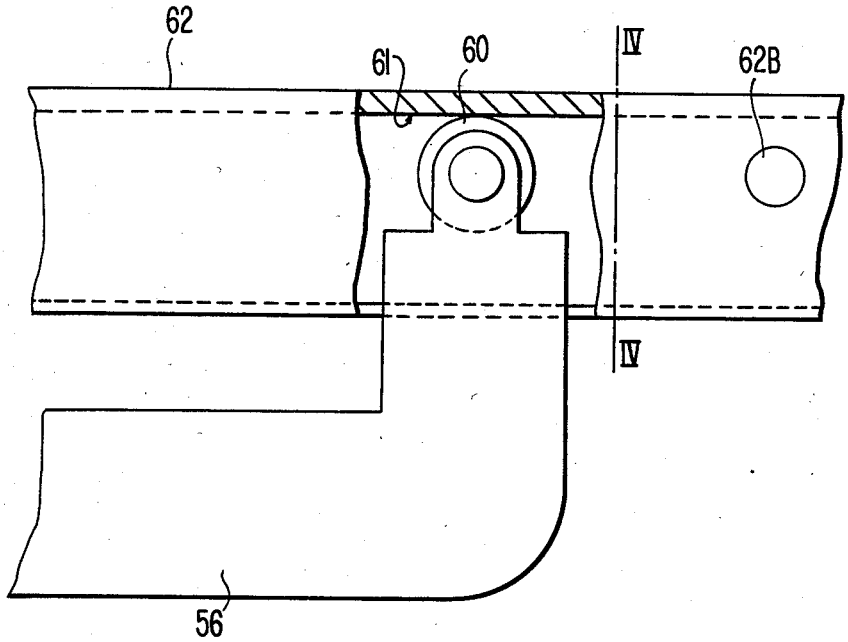
FIGS. 21 and 22 are detailed views of the means for adjusting the slope of one section of the platform with respect to another.
Figure 22:
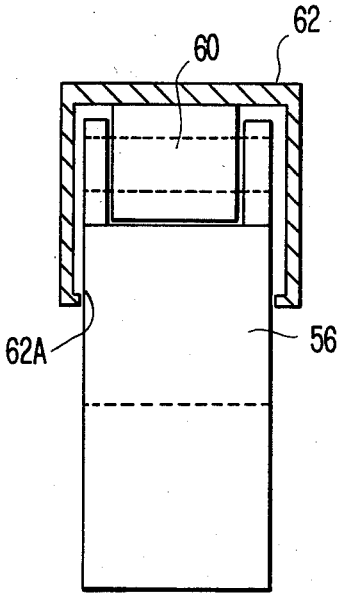

The body of this jack is journalled by any known means for example, on two tabs both integral with median brace 53 and respectively integral with frames 49 and 52. This arrangement permits the mounting of jacks of small dimension so as to avoid wear and tear on the guiding bore of the rod. The other end of lever 56 is provided with a rotating roller 60 bearing against section 3 or 5, as seen in FIGS. 21 and 22. Roller 60 penetrates into the body of the jack when the jack rod opens. In addition, when the jack rod opens to move out of the jack housing, lever 56 rotates around its journal axis pin 59, and roller 60 bears against section 3 or 5 to push section 3 or 5 upward so as to tilt section 3 or 5 with respect to section 4.

Figure 23:
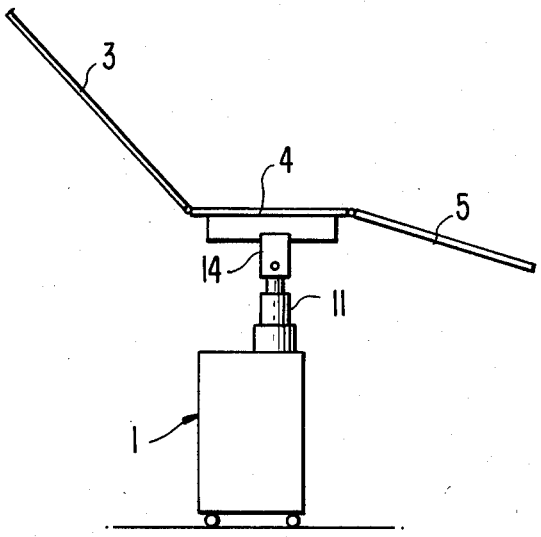
FIGS. 23 and 24 are schematic views showing various slope positions of the sections of the platform with respect to each other.
Figure 24:
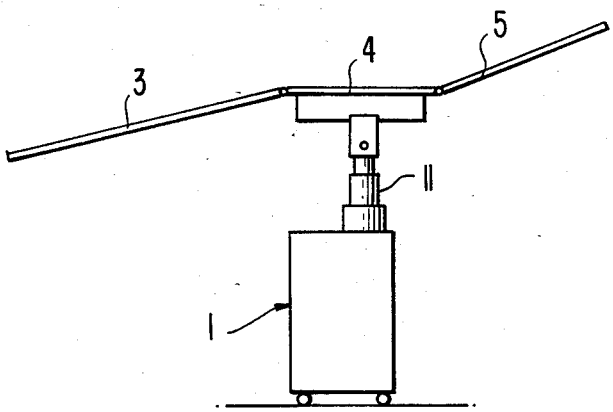

Various positions of the platform sections with respect to each other are shown in FIGS. 23 and 24. Section 3 and section 5 are preferably provided with roller path or surface 61, respectively, adapted to permit the rotation of roller 60 thereon. As can be seen in FIG. 22, each roller surface is located in a tubular element 62 fixed by any known means to a frame 54. This tubular element has a square transverse cross-section and has a lower slot 62A for the passage of the lever and of roller 60. Roller 60 is adapted to bear against roller surface 61 located on the internal face of the upper wall of element 62. A lateral opening 62B is dispoed in element 62 to permit the mounting of one or several rollers and of the axis pin. The frame of each section is covered with plate 63 of a radiotransparent material of any known type.

Figure 20:
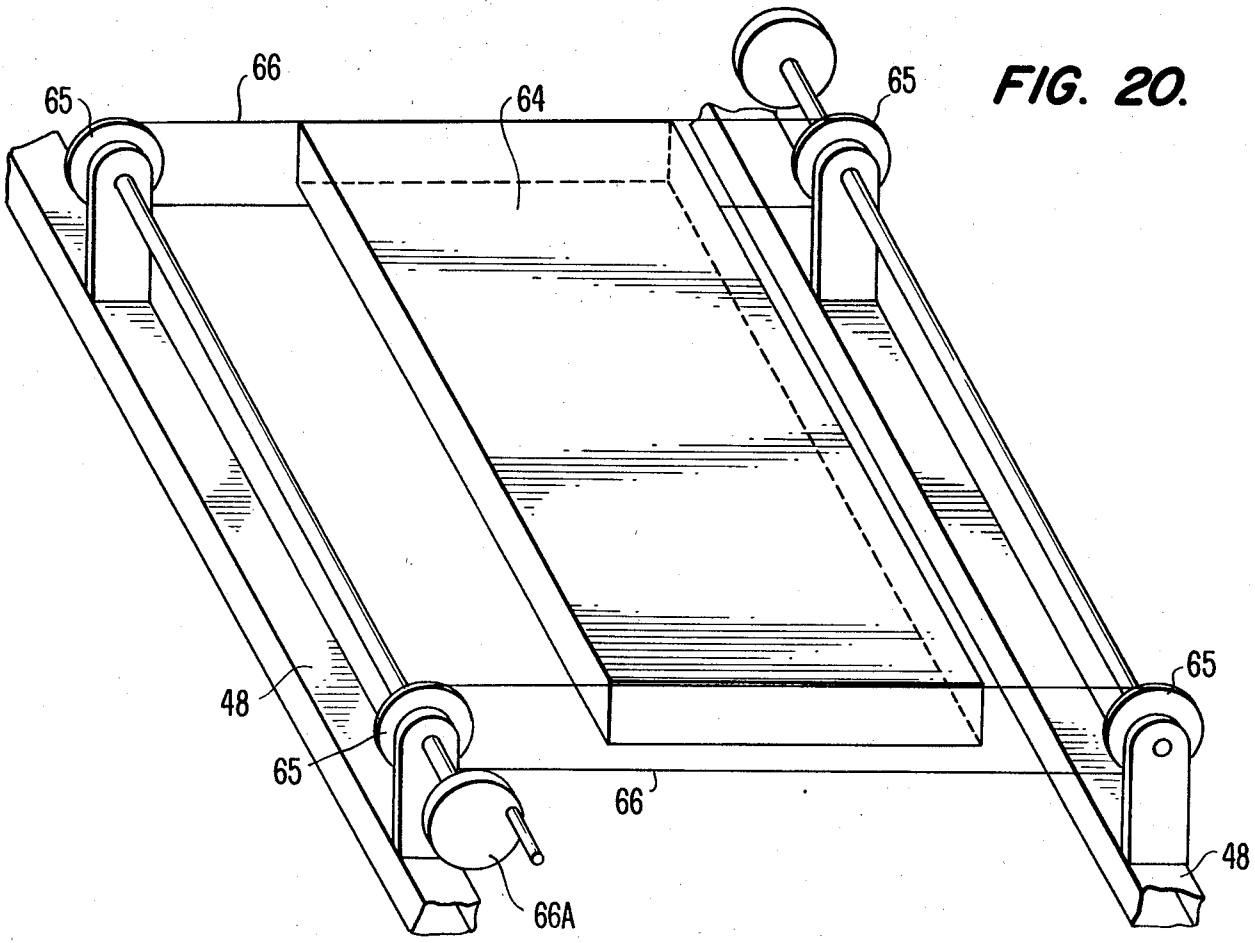
FIG. 20 is a schematic view in perspective of the positioning means of the radiographic box of the present invention.

To X-ray the femoral zone of the patient, median section 4 supports an X-ray box 64 of any known type, and a positioning system therefor above crosspieces 48. As schematically shown in FIG. 20, this system comprises four pulleys 65 connected two-by-two by a cable 66 to which the box 64 is fixed. Two of these pulleys are connected to a maneuvering handle 66A. Two plates 67 are fixed respectively, to two frames 52 in order to protect the movement system. On the radiotransparent material plates, each section is furnished with a mattress of any known type. This mattress is attached, on its plate by adhesive bands (for example, by bands known under the commercial name of "VELCRO").

Each section is also furnished with at leat one rail 68 fixed to frame 52 or to frame 54. Diverse medical instruments can be fixed to this rail by any known means. In FIG. 1, it can be seen that a stand (bec de perroquet) 69 is attached to this rail. Section 2 supporting the dorsal zone of the patient is equipped with a removable headrest 70 of any known type. Section 5, supporting the zone of the lower extremities, is preferably furnished with two removable footrests 71.

It should be noted that in the vertical position, section 5 can be placed at the level of the ground, in order to permit the patient to step on the footrest and to tilt the platform of the bed backwards with the assistance of control housing 8.

It is evident that the bed according to the invention can be equipped with all known accessories, for example, two removable side rails. In the same way, the hydraulic circuit and the electric circuit of the bed are equipped with all necessary safety elements. Thus the bed comprises a voltage implementation switch 70 fixed to the caisson and protected by a lockable flap. In addition housing 8 is fed by low voltage, for example at 12 V, and comprises a pushbutton 73 located in a row on the electromagnets' control circuit. As a result, the user should first push pushbutton 73, and then push the appropriate pushbutton to control the various movement of the bed. This arrangement has as its goal to avoid the user's inopportune maneuvering of the bed. Preferably, pushbutton 73 is located on the back face of housing 8 to ensure that the user will not accidentally adjust the bed.

The present invention is not limited to the specific elements detailed above but extends to all equivalents without going beyond the scope of the present invention.

I claim:

1. A medical bed comprising:

(a) a platform comprising: a plurality of sections, a height, a longitudinal axis having a slope, and a lateral axis having a slope, wherein said sections have a position with respect to each other;

(b) means for adjusting said height of said platform;

(c) means for adjusting said slope of said longitudinal axis of said platform;

(d) means for adjusting said slope of a lateral axis of said platform;

(e) means for adjusting said positions of said sections with respect to each other; and (f) a support, mounted on said height adjustment means, wherein said longitudinal axis slope adjustment means is mounted on said support, said lateral axis slope adjustment means is mounted on said longitudnal axis slope adjustment means, and one section of said platform is mounted on said lateral axis slope adjustment means wherein said support comprises a beam mounted transverse to said platform, wherein said longitudinal axis slope adjustment means comprises:

(i) a shoe, journalled and mounted on said beam; and (ii) a motor element adapted to rotate said shoe clockwise and counterclockwise around said beam, wherein said lateral axis slope adjustment means comprises:

(i) a lower chassis journalled on said shoe along a first axis in the direction of the longitudinal axis of said platform;

(ii) an upper chassis, journalled on said lower chassis around a second axis parallel to said first axis, wherein said upper chassis is adapted to be folded on said lower chassis;

(iii) means for rotating said upper and lower chassis around said first axis so as to tilt the lateral axis of said platform and said bed in a first direction and for rotating said upper chassis around said second axis with respect to said lower chassis, so as to tilt the lateral axis of said platform and said bed in a second direction opposite from said first direction.

2. The medical bed defined by claim 1 wherein said platform comprises a first section, a median section, and a second section, wherein said median section is mounted on said lateral axis slope adjustment means, and wherein said bed further comprises a base, on which said height adjustment means is mounted.

3. The medical bed defined by claim 2 wherein said median section is spaced from said beam and said median section is adapted to be displaced from a horizontal position to a vertical position.

4. The medical bed defined by claim 2 wherein said height adjustment means comprises an upper end and said shoe comprises two bearings comprising means for engaging said beam, and a transverse groove disposed between said two bearings, comprising means for engaging said upper end of said height adjustment means.

5. A medical bed comprising:

(a) a platform comprising: a plurality of sections, a height, a longitudinal axis having a slope, and a lateral axis having a slope, wherein said sections have a position with respect to each other;

(b) means for adjusting said height of said platform;

(c) means for adjusting said slope of said longitudinal axis of said platform;

(d) means for adjusting said slope of said lateral axis of said platform;

(e) means for adjusting said positions of said sections with respect to each other; and (f) a support, mounted on said height adjustment means, wherein said longitudinal axis slope adjustment means is mounted on said support, said lateral axis slope adjustment means is mounted on said longitudinal axis slope adjustment means, and one section of said platform is mounted on said lateral axis slope adjustment means, wherein said platform comprises a first section, a median section, and a second section, wherein said median section is mounted on said lateral axis slope adjustment means, wherein said support comprises a beam mounted transverse to said platform, and wherein said bed further comprises a base, on which said height adjustment means is mounted, wherein said longitudinal axis slope adjustment means comprises:

(i) a shoe, journalled and mounted on said beam; and (ii) a motor element adapted to rotate said shoe clockwise and counterclockwise around said beam, wherein said beam comprises two tabs integral therewith and said shoe further comprises a tab integral therewith, wherein said motor element comprises a hydraulic jack having a body and a rod comprising means to reciprocate therein, wherein said body is journalled on said two tabs of said beam and said rod is journalled on said tab of said shoe, wherein said tabs and said hydraulic jack are mounted laterally with respect to said height adjustment means.

6. The medical bed defined by claim 5 wherein said tab integral with said shoe comprises a bearing disposed between said two tabs integral with said beam, wherein said bearing comprises means for engaging said beam.

7. A medical bed comprising:

(a) a platform comprising a plurality of sections, a height, a longitudinal axis having a slope, and a lateral axis having a slope, wherein said sections have a position with respect to each other;

(b) means for adjusting said height of said platform;

(c) means for adjusting said slope of said longitudinal axis of said platform;

(d) means for adjusting said slope of said lateral axis of said platform;

(e) means for adjusting said positions of said sections with respect to each other; and (f) a support, mounted on said height adjustment means, wherein said longitudinal axis slope adjustment means is mounted on said support, said lateral axis slope adjustment means is mounted on said longitudinal axis slope adjustment means, and one section of said platform is mounted on said lateral axis slope adjustment means, wherein said platform comprises a first section, a median section, and a second section, wherein said median section is mounted on said lateral axis slope adjustment means, wherein said support comprises a beam mounted transverse to said platform, and wherein said bed further comprises a base, on which said height adjustment means is mounted wherein said median section comprises a frame and said lateral axis slope adjustment means comprises:

(i) a lower chassis journalled on said shoe along a first axis in the direction of the longitudinal axis of said platform;

(ii) an upper chassis, journalled on said lower chassis around a second axis parallel to said first axis, and comprising a lever, wherein said upper chassis is integral with said frame of said median section and said upper chassis is adapted to be folded on said lower chassis;

(iii) at least one motor element for rotating said upper and lower chassis around said first axis so as to tilt the lateral axis of said platform and said bed in a first direction; and (iv) at least one motor element for rotating said upper chassis around said second axis via said lever, so as to tilt the lateral axis of said platform and said bed in a second direction opposite from said first direction.

8. The medical bed defined by claim 7 wherein said shoe includes a cylindrical opening therein, and wherein said lower chassis comprises:

a journal axis pin comprising means for rotating in said cylindrical opening in said shoe; and at least a first pair of rods perpendicular to said axis pin and each having two ends, one of said ends of each rod being attached to said axis pin, and the other of said ends being journalled on said upper chassis.

9. The medical bed defined by claim 8 wherein said shoe has two ends and said lower chassis further comprises at least a second pair of rods, located, respectively, at each end of said shoe, wherein each rod contacts one end of said shoe so as to comprise means for preventing movement of said platform relative to said other elements of said bed when said platform is in a vertical position.

10. The medical bed defined by claim 9 wherein said upper chassis comprises:

a plurality of rods parallel to said first and second pair of rods on said lower chassis; and at least a first and a second axis pin, parallel to said second axis, wherein said first and second axis pins are integral with said frame of said median section, and wherein said first axis pin is rotatably mounted at one end of said first and second pairs of rods of said lower chassis and is rotatably mounted on said plurality of rods on said upper chassis.

11. The medical bed defined by claim 10 wherein said plurality of rods on said upper chassis contact said journal axis pin of said lower chassis when said upper chassis is folded on said lower chassis.

12. The medical bed defined by claim 7 wherein said lower chassis comprises at least two rods at each end of said shoe, wherein said shoe comprises two tabs integral therewith, and wherein said first motor comprises a hydraulic jack having a body and a rod adapted to reciprocate therein, wherein said body is journalled on said two tabs of said shoe and said rod of said jack is journalled on said two rods of said lower chassis disposed at each end of said shoe.

13. The medical bed defined by claim 1 wherein said lower chassis comprises a journal axis pin, and two tabs integral therewith, and wherein said second motor element comprises a hydraulic jack having a body and a rod adapted to reciprocate therein, wherein said body is journalled on said two tabs integral with said journal axis pin, and said rod is journalled to said lever.

14. The medical bed defined by claim 7 wherein said lower chassis comprises a journal axis pin and wherein said lever is rotatably mounted on said journal axis pin under said upper chassis and wherein said lever further comprises at least one roller bearing against said upper chassis.

15. The medical bed defined by claim 7 wherein said section position adjusting means comprises means to adjust the slope of said first and third sections with respect to said median section, wherein said first and third section slope adjusting means comprises:

(i) a lever journalled to said median section under one of said first and third sections; and (ii) a motor element comprising a hydraulic jack having a body and a rod adapted to reciprocate therein, wherein said body is journalled on said median section and said rod is journalled on said lever.

16. The medical bed defined by claim 15 wherein said lever comprises at least one roller bearing against one of said first and third sections.

17. The medical bed defined by claim 1 wherein said platform comprises a median section mounted on said lateral axis slope adjustment means, wherein said upper chassis comprises a lever, wherein said median section comprises a frame, wherein said upper chassis is integral with said frame of said median section, wherein said rotating means comprises at least one motor element for rotating said upper and lower chassis around said first axis and at least one motor element for rotating said upper chassis around said second axis via said lever.

* * * * *